US008205722B2

(12) United States Patent
Suihkonen et al.

(10) Patent No.: US 8,205,722 B2
(45) Date of Patent: Jun. 26, 2012

(54) METHOD AND SYSTEM FOR DIVIDING DESTINATION CALLS IN ELEVATOR SYSTEM

(75) Inventors: Kari Suihkonen, Hyvinkää (FI); Marja-Liisa Siikonen, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/064,886

(22) Filed: Apr. 25, 2011

(65) Prior Publication Data

US 2011/0214948 A1 Sep. 8, 2011

Related U.S. Application Data

(63) Continuation of application No. PCT/FI2009/000092, filed on Oct. 23, 2009.

(30) Foreign Application Priority Data

Oct. 24, 2008 (FI) ..... 20080590

(51) Int. Cl.
*B66B 1/20* (2006.01)

(52) U.S. Cl. ..... 187/383; 187/392

(58) Field of Classification Search ..... 187/247, 187/248, 249, 380–388, 391–393
See application file for complete search history.

(56) References Cited

U.S. PATENT DOCUMENTS

| | | | | | |
|---|---|---|---|---|---|
| 4,838,385 | A * | 6/1989 | Ekholm | 187/247 |
| 4,895,223 | A * | 1/1990 | Ekholm et al. | 187/383 |
| 5,480,005 | A * | 1/1996 | Bittar | 187/383 |
| 5,719,360 | A * | 2/1998 | Davis et al. | 187/383 |
| 5,831,226 | A * | 11/1998 | Hattori et al. | 187/382 |
| 6,065,570 | A | 5/2000 | Friedli et al. | |
| 6,871,727 | B2 * | 3/2005 | Jokela et al. | 187/383 |
| 6,945,365 | B2 * | 9/2005 | Matela | 187/382 |
| 7,117,980 | B2 * | 10/2006 | Wyss et al. | 187/383 |
| 7,128,190 | B2 * | 10/2006 | Kostka et al. | 187/383 |
| 7,258,203 | B2 * | 8/2007 | De Jong et al. | 187/383 |
| 2002/0129994 | A1 | 9/2002 | Kostka et al. | |
| 2003/0000776 | A1 | 1/2003 | Kostka | |
| 2004/0163895 | A1 | 8/2004 | Kostka et al. | |
| 2004/0262092 | A1 * | 12/2004 | Wyss et al. | 187/383 |
| 2005/0077115 | A1 * | 4/2005 | Urata | 187/383 |
| 2008/0236956 | A1 | 10/2008 | Finschi | |

OTHER PUBLICATIONS

International Search report from parent application No. PCT/FI2009/000092 mailed Feb. 12, 2010.

* cited by examiner

*Primary Examiner* — Anthony Salata
(74) *Attorney, Agent, or Firm* — Harness, Dickey & Pierce, P.L.C.

(57) ABSTRACT

In an elevator system including at least two elevator groups having at least one shared floor and destination call appliances on at least the shared floor for receiving destination calls from passengers, destination call appliances are connected to group controls of the elevator groups. Destination calls from passengers are divided between the elevator groups based on defined division criteria.

12 Claims, 2 Drawing Sheets

METHOD AND SYSTEM FOR DIVIDING DESTINATION CALLS IN ELEVATOR SYSTEM

CROSS-REFERENCE TO RELATED APPLICATIONS

Figure 1:
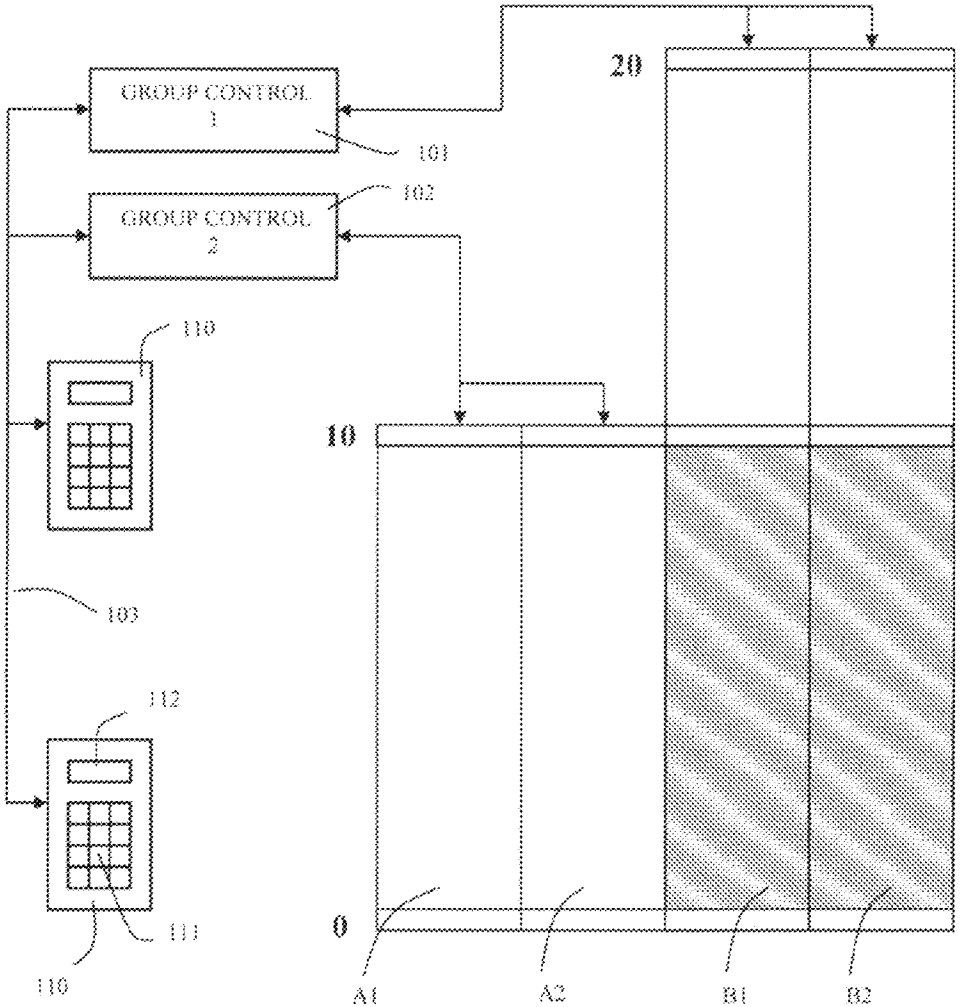

This application is a continuation of PCT/FI2009/000092 filed on Oct. 23, 2009, which is an international application claiming priority from FI 20080590 filed on Oct. 24, 2008, the entire contents of which are hereby incorporated by reference.

FIELD OF THE INVENTION

The invention relates to elevator systems. More particularly the invention relates to a method and to a system for dividing elevator calls between elevator groups.

BACKGROUND OF THE INVENTION

High-rise buildings typically contain a number of elevators, escalators and other corresponding traveling means for transporting people from one floor to another in the building. When passengers on the floor levels give calls to the elevators, the group control of the elevator group allocates elevator cars for the use of the passengers on the basis of the desired optimization criteria. The giving of calls in a conventional elevator system is arranged by disposing up/down pushbuttons on each floor level, by means of which a passenger expresses his/her desired direction of travel and further, after the elevator car has reached the floor level on which the passenger is located, the passenger expresses in the elevator car his/her desired destination floor level by means of the destination floor pushbuttons in the elevator car. The method of giving calls described above is, however, impractical and often inefficient, as a result of which the giving of calls in elevator systems is implemented to an increasing extent by means of so-called destination call systems, in which each passenger expresses his/her personal destination floor already at the departure floor, e.g. in the entrance lobby before going into the elevator car. The giving of a destination call takes place by means of a special destination call terminal, either with pushbuttons or by means of an electrically readable identifier, e.g. an RFID (radio frequency identifier) tag. Since in connection with a destination call the departure point and terminal point of the travel route of each passenger is identified and therefore available to the group control, the group control is able to determine the travel route of a passenger precisely and optimally compared to a conventional call-giving system.

In large building complexes passengers are generally served by more than one elevator group. Often an elevator system is implemented in such a way that a passenger gets to the destination floor he/she wants using only a certain elevator group, in which case the elevator passenger must have advance information about which floors each elevator group serves and must give at the departure floor an elevator call to exactly the correct elevator group in order to get to the destination floor. Finding the correct elevator group can, however, be awkward especially in large buildings, causing uncertainty in the passenger when choosing the correct travel route. On the other hand, if a passenger has available for use a number of elevator groups for getting to the destination floor he/she wants, one problem that can arise is that the passenger does not have any information about the degree of loading of the different elevator groups, in which case he/she can choose a more congested elevator group instead of choosing an uncongested elevator group that would probably serve him/her more quickly.

One possible way to solve the problems described above is to combine the elevator groups and to implement the whole elevator system as one elevator group, in which the allocation of calls occurs in one group control. Efficient allocation of calls and all kinds of optimization of the traffic of the elevator group requires of the group control, however, computation of complex algorithms and therefore very efficient data processing ability if the number of elevators in the elevator group is great. In this case the group control becomes complicated and expensive compared to a simpler standard group control, which is optimized for control of a smaller elevator group comprising e.g. a maximum of 8 elevators.

PURPOSE OF THE INVENTION

The purpose of the present invention is to eliminate or at least to alleviate the aforementioned drawbacks that occur in prior-art solutions. The purpose of the invention is also to achieve one or more of the following objectives:

- a solution by means of which large elevator systems can easily be implemented using standard group controls or group controls comparable to them,
- a solution in which a passenger easily finds the elevator serving him/her in an elevator system comprising a number of elevator groups,
- a solution that enables optimal division and use of transport capacity between elevator groups,
- an elevator system in which the computing capacity can efficiently be distributed.

SUMMARY OF THE INVENTION

One embodiment, provides a method for dividing destination calls between elevator groups in an elevator system, the elevator system including at least two elevator groups having one or more shared floors, the elevator system further including destination call appliances on at least the one or more shared floors to receive destination calls from passengers, the method comprising: conveying destination call information from the destination call appliances to the elevator groups via group controls of the elevator groups; defining division criteria for the destination calls, the division criteria including primary division criteria and one or more secondary division criteria; and dividing, on a per-destination call basis, the destination calls from the passengers between the elevator groups based on the defined one or more secondary division criteria if a passenger can be served with two or more elevator groups based on the primary division criteria. Another embodiment provides an elevator system comprising: at least two elevator groups, each of the at least two elevator groups having one or more shared floors; and a destination call appliance on each of the one or more shared floors, the destination call appliances being configured to receive destination calls from passengers, the destination call appliances being connected to group controls for the at least two elevator groups by an equipment bus, the destination call appliances being configured to convey destination call information to the at least two elevator groups, and the destination call appliances being arranged to divide, on a per-destination call basis, the destination calls from the passengers between the at least two elevator groups based on one or more secondary division criteria if a passenger can be served with two or more elevator groups based on a primary division criteria. Other embodiments of the invention are characterized by what is disclosed herein, including the drawings and the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

In the following the meaning of certain terms used in this context is explained in more detail:

traffic situation: defines the traffic type and/or the traffic intensity prevailing in an elevator group. The traffic type indicates the direction of the passenger flows generally prevailing in the elevator system, e.g. upward traffic (from the entrance lobby to the other floors of the building), downward traffic (from the other floors of the building to the entrance lobby), internal traffic (traffic between floors), two-way traffic (simultaneous downward traffic and upward traffic), mixed traffic (a combination of different traffic types). The traffic intensity indicates how heavy the traffic prevailing in the elevator system is in relation to the maximum transportation capacity of the elevator group, e.g. light traffic, normal traffic, heavy traffic and intensive traffic. In addition to the above, many other categorizations of traffic types and traffic intensities are possible.

division criterion of a call: the term refers to the rules on the basis of which a destination call given by a passenger is addressed for allocation to some elevator group of the elevator system. The division criteria can be further categorized into primary division criteria and secondary division criteria.

allocation cost of a call: the term refers to the estimated cost term that describes the ability of an elevator group to serve a call in relation to one or more desired optimization criteria. An optimization criterion can be e.g. waiting time, travel time, energy, energy consumption or some combination of these. The smaller the allocation cost is, the better the elevator group can serve the call.

The present invention also discloses a method for dividing destination calls between elevator groups in an elevator system, which comprises at least two elevator groups, which elevator groups have one or more shared floors and also destination call appliances on at least the shared floors for receiving destination calls given by passengers. According to the method, the destination call appliances are connected to the group controls of the elevator groups, the division criteria of calls are defined, and the destination calls given by passengers are divided between the elevator groups on the basis of the aforementioned division criteria.

The present invention also discloses an elevator system, which comprises two or more elevator groups, which elevator groups have one or more shared floors and destination call appliances on at least the aforementioned shared floors for receiving destination calls given by passengers. In the elevator system according to the invention the aforementioned destination call appliances are connected to the group controls of the elevator groups, and arranged to divide the destination calls given by passengers between the elevator groups on the basis of the given division criteria.

In one embodiment of the invention the floor zones served by each elevator group are defined, which floor zones are used as a primary division criterion of calls when dividing the destination calls given by passengers between elevator groups.

In one embodiment of the invention one or more secondary division criteria of calls are defined for dividing the destination calls given by passengers between elevator, groups in cases in which on the basis of a primary division criterion a passenger can be served with two or more elevator groups.

In one embodiment of the invention the destination call appliances define the elevator group serving the call on the basis of the given division criteria. In the embodiment decision-making about the elevator group is distributed between destination call appliances such that a decision about the elevator group to serve a passenger is made in the destination call appliance from which the passenger has given his/her call.

In one embodiment of the invention the division criteria of calls are defined for destination call appliances individually. In this embodiment the division criteria can be defined for any destination call appliance whatsoever differently from the division criteria of the other destination call appliances. As a result of the embodiment the division of calls can be optimized for specific floors in order to achieve the desired service targets.

In one embodiment of the invention rules are used as secondary division criteria, in which rules the division of calls is performed on the basis of a given ratio, on the basis of additional information connected to a call, on the basis of the identification data of a passenger, and/or on the basis of the allocation cost connected to a call.

In one embodiment of the invention the destination call appliances are arranged to receive from the group controls of elevator groups group-specific information connected to the division of calls, which information is taken into account in the division criteria of calls. In this embodiment the destination call appliances receive from the group controls information that can be used for optimizing the division of calls between elevator groups. A destination call appliance that has received a call can e.g. send the destination call information to the group controls, as a response to which the destination call appliance receives from each group control an estimate of the desired allocation cost, e.g. of the waiting time, if the call were allocated to the group control in question. On the basis of the information received, the destination call appliance conveys the destination call give by a passenger for allocation to the group in which the waiting-time estimate is shortest. As a result of the embodiment the transport capacity can be efficiently divided between elevator groups.

In one embodiment of the invention the division criteria of calls are dynamically changed on the basis of the estimated traffic situation in the elevator groups and/or on the basis of an exceptional situation detected in the elevator system. As a result of the embodiment the changes occurring in the state of the elevator system can be taken into account in the division criteria of calls and the division of calls can be implemented optimally in changing circumstances. The division criteria can be dynamically changed according to the traffic situation prevailing in the elevator system at any time and thus the transport capacity of the elevator system and/or another desired service target of the elevator system can be optimized. As a result of the embodiment the operation of the elevator system can be optimized also in exceptional circumstances e.g. when one or more elevators are out of transport use or when evacuating the building e.g. owing to a fire detected in the building.

With the solution according to the invention numerous advantages are achieved compared to prior-art solutions. By means of the solution, also large elevator systems can be implemented by dividing an elevator system into a number of elevator groups, which can be controlled using simple standard group control systems. The passenger does not need to have information about which floors each elevator group serves, in which case he/she can easily find the way to the elevator serving him/her. An elevator can be allocated to a passenger immediately in connection with giving a call, he/she can be guided from the call giving appliance to the correct elevator lobby and to the allocated elevator. The solution according to the invention also takes into account the traffic situation prevailing in the elevator groups and/or an exceptional situation, enabling optimal use of the transport capacity of the elevator system at the same time improving the passenger service level. Passengers can also receive individual service on the basis of additional information connected to a call or on the basis of identification of the passenger. Another advantage of the present invention is that the division of calls, the allocation of calls and other data processing can be distributed in the elevator system between a number of different units, in which case the solution becomes simple and effective, and which can be easily applied and modified in implementations of different types of elevator systems.

LIST OF FIGURES

In the following, the invention will be described in detail by the aid of a few examples of its embodiments, wherein:

FIG. 1 presents one elevator system according to the invention; and

Figure 2:
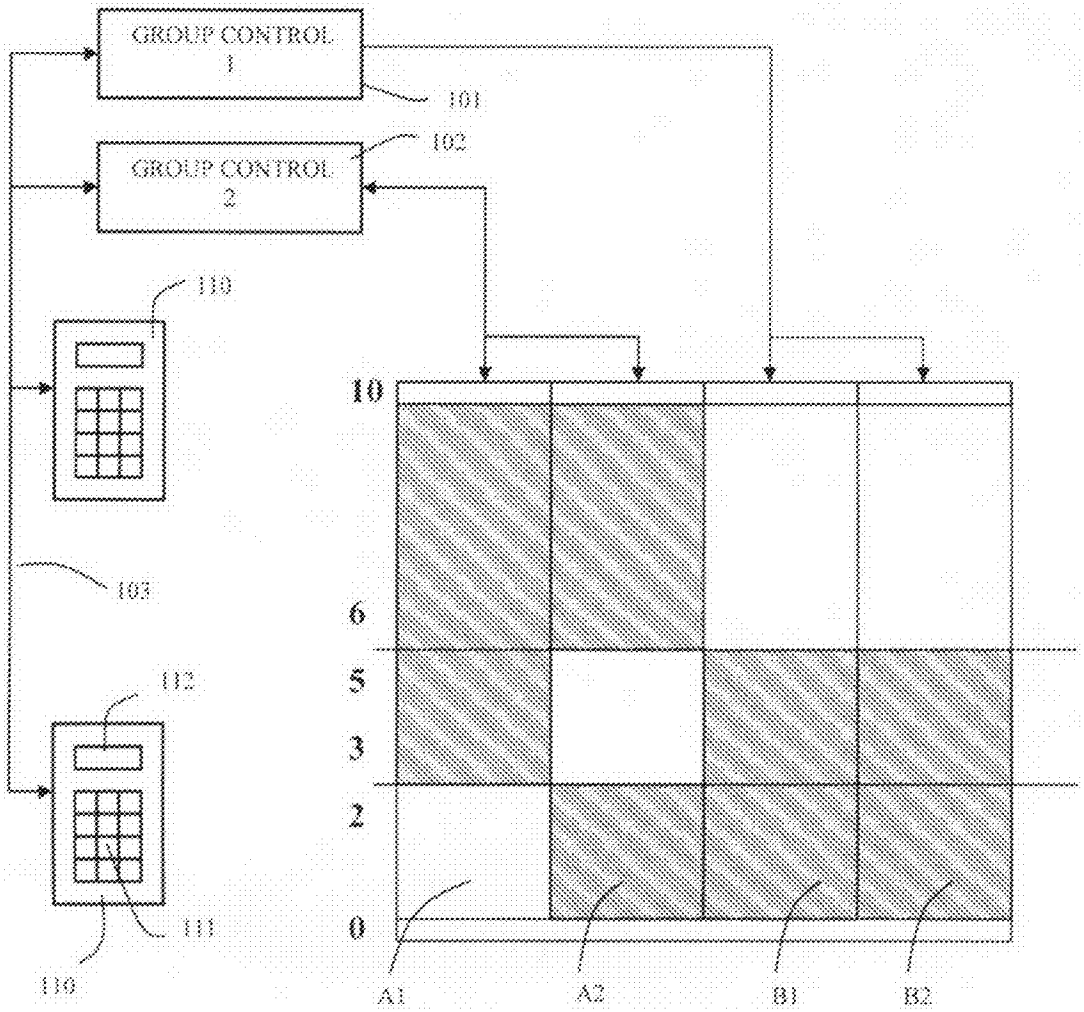

FIG. 2 presents a second elevator system according to the invention.

DETAILED DESCRIPTION OF THE INVENTION

FIG. 1 presents an elevator system, which comprises two elevator groups A and B. The elevators A1 and A2 of the elevator group A serve the floors 0-10 of the building, and the elevators B1 and B2 of the elevator group B serve the floors 0, 10-20. Since floors 0 and 10 are served with both elevator group A and B, the floors 0 and 10 are shared floors of the elevator groups A and B. According to FIG. 1 destination call appliances 110, which are connected via an equipment bus 103 to the group controls 101 and 102 of the elevator groups A and B, are installed on the shared floor levels 0 and 10. Other floors than the shared floors 0 and 10 can be provided with destination call appliances or landing call appliances (up/down pushbuttons) and can be connected in a corresponding manner to the group controls 101 and 102, or alternatively connected directly to the group control 101 or 102 (not presented in FIG. 1) serving the floor level in question. The number and placement of the call-giving appliances on the floors can be freely selected, e.g. an extra destination call appliance can be disposed in the entrance lobby for people leaving the entrance, in which case a passenger can indicate his/her destination floor in good time before arriving at the elevators.

Information about which floor zones each elevator group A, B serves is stored in the destination call appliances 110. When a passenger gives a destination call on floor level 0 or 10, the destination call appliance that received the call determines, on the basis of the aforementioned floor zones, which of the elevator groups of the elevator system can serve the call (so-called primary distribution criterion). If the result of the determination is only one elevator group (A or B), the destination call appliance conveys the destination call information connected to the destination call via the equipment bus 103 to the group control of the elevator group in question, which group control allocates an elevator car to the passenger using in themselves prior-art allocation methods. Thus, for example, in the case according to FIG. 1 all the destination calls from floor 0 and floor 10 to floors 1-9 are served always with the elevators of elevator group A and correspondingly all the destination calls from floor 0 and floor 10 to floors 11-20 are served with elevators of elevator group B. When the group control, to which the call given by a passenger is conveyed, has allocated an elevator car to the passenger, the group control sends information about the allocated elevator to the destination call appliance that sent the call, in which destination call appliance the elevator to serve the passenger is indicated, e.g. with a display means 112 of the destination call appliance and/or auditively.

If on the basis of a primary division criterion a passenger can be served with two or more elevator groups, an additional condition is needed, on the basis of which additional condition the elevator group to serve the call can be selected. For example, in the case according to FIG. 1 destination calls from floor 0 to floor 10 can be served both with elevators of elevator group A and with elevators of elevator group B. So-called secondary division criteria are used as an additional condition in the solution according to the invention, in which secondary division criteria it is endeavored to optimize e.g. the transport capacity of the elevator system and/or factors connected to the service times of a call. In the following some examples of secondary division criteria are presented, on the basis of which the elevator group serving the call can be selected:

- calls are divided between elevator groups in a given ratio. A ratio is, or ratios are, defined in the criterion, in which ratio or ratios calls are divided between the elevator groups. For example, in the case according to FIG. 1 both elevator groups comprise just as many elevators (2 units), in which case each second call can be conveyed to elevator group A and every other call to elevator group B when traveling from floor 0 to floor 10 or vice versa.
- on the basis of additional information attached to the call. A passenger gives additional information in connection with a call, which additional information is taken into account when selecting the elevator group to serve the call. Additional information can be e.g. information indicating handicapped transport, which a passenger gives with a destination call appliance in connection with a call. In this case e.g. a certain elevator group can be selected from the elevator system, which elevator group is used for handicapped transport on the basis of the fact that it is more easily reachable from the destination call appliance from which the call is given.
- on the basis of identification of the passenger: A profile is defined for each passenger, which profile indicates an elevator group with which the passenger is primarily served and possibly a default value for the destination floor of the passenger. When a passenger arrives e.g. at the entrance lobby 0, the passenger is identified with a reading device that is in connection with the call-giving appliance. On the basis of the identification, the destination floor of the passenger is determined and an elevator is allocated to the destination floor of the passenger from the elevator group determined by the profile. Any identification method whatsoever can be used for identification of a passenger, e.g. identification based on RFID technology.
- on the basis of the allocation cost connected to a call: The allocation cost connected to service of a call is defined for each elevator group, e.g. the estimated waiting time of a passenger, and the call is given for serving to an elevator group in which the estimated cost is the smallest, e.g. the waiting time is the shortest. The allocation cost can be determined in the destination call appliance itself or in the group controls.

According to one embodiment of the invention the destination call appliances 110 are arranged to receive from the group controls group-specific information connected to the division of calls, which information can be taken into account in the division criteria of calls. The group control can e.g. convey information about the floor zones served by an elevator group at that time via an equipment bus 103 to the destination call appliances. The destination call appliances can also convey to the group controls the destination call information connected to a call given by a passenger, as a response to which the destination call appliances receive from each group control an estimate of the allocation cost connected to the call, on the basis of which the destination call appliance can select that elevator group in which the aforementioned allocation cost is the smallest as the elevator group to serve the call.

The division criteria of calls can be defined also individually for each destination call appliance such that the division criteria of calls in at least one destination call appliance differ from the division criteria of some other destination call appliances. For example, the waiting time connected to a call can be optimized on certain floors by means of different division criteria whereas the energy consumption connected to a call can be optimized on a certain other floor.

FIG. 2 presents a second elevator system according to the invention, in which both elevator group A and elevator group B can serve all the floors 0-10 of the building. Destination call appliances 110, which are connected to the group controls 101 and 102 in the manner of FIG. 1, are installed on all the floor levels. The floors 0-10 are divided into floor zones such that the elevator A1 serves the floors 0-2, the elevator A2 floors 0, 3-5, the elevators B1 and B2 floors 0, 6-10. If a passenger in the entrance lobby 0 gives a destination call to one of the floors 1-5, the call is conveyed to the elevator group A on the basis of the zone division. Correspondingly, if a destination call is for floors 6-10, the call is conveyed to the elevator group B. According to one embodiment of the invention, the division criteria of calls are changed dynamically on the basis of the traffic situation prevailing in the elevator system and/or on the basis of an exceptional situation. For example in the elevator system according to FIG. 2 the zone borders of the zones can be changed dynamically on the basis of the estimated traffic type and/or traffic intensity. Correspondingly, if one of the elevators of the elevator system is out of service, the zone borders can be changed so that all the floors can be served equally. During light traffic zoning can be removed completely, in which case both the elevator groups A and B of FIG. 2 serve all the floors 0-10 of the building. The division of calls is then based on the defined secondary division criteria.

In order to determine the traffic situation prevailing in the elevator groups, each elevator group comprises a so-called traffic forecaster, which records statistical information about the travel events of the elevator group at different times over the 24-hour period and on weekdays. Utilizing statistical data and the calls given, the traffic forecaster can determine the traffic type and/or the traffic intensity prevailing in the elevator system at any given time.

It is obvious to the person skilled in the art that different embodiments of the invention are not limited to the example described above, but that they may be varied within the scope of the claims presented below.

The invention claimed is:

1. A method for dividing destination calls between elevator groups in an elevator system, the elevator system including at least two elevator groups having one or more shared floors, the elevator system further including destination call appliances on at least the one or more shared floors to receive destination calls from passengers, the method comprising:

conveying destination call information from the destination call appliances to the elevator groups via group controls of the elevator groups;

defining division criteria for the destination calls, the division criteria including primary division criteria and one or more secondary division criteria; and dividing, on a per-destination call basis, the destination calls from the passengers between the elevator groups based on the defined one or more secondary division criteria if a passenger can be served with two or more elevator groups based on the primary division criteria.

2. The method according to claim 1, further comprising:

defining floor zones to be served by each elevator group; and utilizing the floor zones as a primary criteria for dividing the destination calls.

3. The method according to claim 1, wherein the destination call appliances are arranged to define the elevator group serving a destination call on the basis of the division criteria.

4. The method according to claim 1, wherein the division criteria are defined individually for one or more destination call appliances.

5. The method according to claim 1, wherein the division criteria includes group-specific information associated with the division of the destination calls, and wherein the destination call appliances are arranged to receive the group-specific information from the group controls of elevator groups.

6. The method according to claim 3, wherein the secondary division criteria includes at least one of a given ratio, additional information associated with a destination call, identification data of a passenger, and allocation cost associated with a destination call.

7. The method according to claim 1, further comprising:

dynamically changing the division criteria based on at least one of an estimated traffic situation in the elevator groups and an exceptional situation detected in the elevator system.

8. An elevator system, comprising:

at least two elevator groups, each of the at least two elevator groups having one or more shared floors; and a destination call appliance on each of the one or more shared floors, the destination call appliances being configured to receive destination calls from passengers, the destination call appliances being connected to group controls for the at least two elevator groups by an equipment bus, the destination call appliances being configured to convey destination call information to the at least two elevator groups, and the destination call appliances being arranged to divide, on a per-destination call basis, the destination calls from the passengers between the at least two elevator groups based one or more secondary division criteria if a passenger can be served with two or more elevator groups based on a primary division criteria.

9. The elevator system according to claim 8, wherein the destination call appliances are arranged to use floor zones served by the at least two elevator groups as the primary division criteria.

10. The elevator system according to claim 8, wherein the primary and secondary division criteria are defined individually for each destination call appliance.

11. The elevator system according to claim 8, wherein the destination call appliances are arranged to receive group-specific information associated with the division of destination calls from the group controls of the at least two elevator groups via the equipment bus.

12. The elevator system according to claim 8, wherein the elevator system is configured to dynamically change the one or more secondary division criteria based on at least one of an estimated traffic situation in the at least two elevator groups and an exceptional situation detected in the elevator system.

* * * * *